US011820965B1

(12) United States Patent
Randmae et al.

(10) Patent No.: US 11,820,965 B1
(45) Date of Patent: Nov. 21, 2023

(54) AQUEOUS CLEANER COMPOSITION

(71) Applicants: Alan Lembit Randmae, Centerport, NY (US); Rein S Randmae, Northport, NY (US)

(72) Inventors: Alan Lembit Randmae, Centerport, NY (US); Rein S Randmae, Northport, NY (US)

( * ) Notice: Subject to any disclaimer, the term of this patent is extended or adjusted under 35 U.S.C. 154(b) by 0 days.

(21) Appl. No.: 18/314,068

(22) Filed: May 8, 2023

(51) Int. Cl.

| | |
|---|---|
| ***C11D 1/04*** | (2006.01) |
| ***C11D 3/37*** | (2006.01) |
| ***C11D 1/14*** | (2006.01) |
| ***C11D 3/43*** | (2006.01) |
| ***C11D 3/382*** | (2006.01) |
| ***C11D 3/40*** | (2006.01) |
| ***C11D 11/00*** | (2006.01) |
| ***C11D 17/00*** | (2006.01) |

(52) U.S. Cl.
CPC ..... *C11D 3/373* (2013.01); *C11D 1/146* (2013.01); *C11D 3/382* (2013.01); *C11D 3/40* (2013.01); *C11D 3/43* (2013.01); *C11D 11/0029* (2013.01); *C11D 11/0035* (2013.01); *C11D 11/0058* (2013.01); *C11D 17/0017* (2013.01)

(58) Field of Classification Search
CPC ..... C11D 3/3765
USPC ..... 510/180
See application file for complete search history.

(56) References Cited

U.S. PATENT DOCUMENTS

| | | | |
|---|---|---|---|
| 3,463,735 | A | 8/1969 | Stonebraker |
| 4,315,828 | A | 2/1982 | Church |
| 5,534,198 | A | 7/1996 | Masters et al. |
| 5,716,921 | A | 2/1998 | Neumiller |
| 5,726,139 | A | 3/1998 | Willey et al. |
| 5,750,482 | A | 5/1998 | Cummings |
| 5,849,681 | A | 12/1998 | Neumiller et al. |
| 6,420,326 | B1 | 7/2002 | Maile et al. |
| 6,461,537 | B1 | 10/2002 | Turcotte et al. |
| 7,314,852 | B1 | 1/2008 | Cummings et al. |
| 8,114,223 | B2 | 2/2012 | Brueckner et al. |
| 8,641,827 | B2 | 2/2014 | Blattner et al. |
| 2010/0062965 | A1 | 3/2010 | Brueckner et al. |

FOREIGN PATENT DOCUMENTS

CN 107937161 A * 4/2018 ..... C09K 3/18

* cited by examiner

*Primary Examiner* — Gregory E Webb
(74) *Attorney, Agent, or Firm* — Tutunjian & Bitetto, P.C.

(57) ABSTRACT

An aqueous cleaner composition providing good lubricity for obtaining superior cleaning and anti-streaking results on hard surfaces such as glass and stainless steel as well as plastic windows and the like. The cleaner composition includes water, isopropyl alcohol, droplets of polydimethylsiloxane dispersed within the cleaner composition for creating a lubricated surface. According to one implementation, sodium dodecyl sulfate is the surfactant which assists in soil removal. Essential oils can be added for fragrance, and colorants added for visual appearance.

21 Claims, No Drawings

AQUEOUS CLEANER COMPOSITION

TECHNICAL FIELD

The present invention relates to liquid cleaner compositions and in particular cleaner compositions providing enhanced lubricity to obtain anti-streaking performance, and which can be used for hard surfaces such as glass, comprising various cleaning agents such as water, alcohol, vinegar, detergents, and the like.

BACKGROUND

The art of cleaning hard surfaces such as glass consists of three components: 1) the cleaner composition used for this purpose: 2) the skill of the operator performing the cleaning operation: and 3) the medium used to apply the cleaner composition to the surface. All of these components have a role in the successful outcome of the cleaning operation There are numerous products in the marketplace and described in prior art references used for cleaning glass surfaces. Many of these cleaner compositions include additives such as polyethylene glycol, ethylene glycol monohexyl ether, surfactants, and the like for exhibiting good cleaning properties.

SUMMARY

It is an object of the embodiment described herein to provide a cleaner composition comprising silicone oil droplets dispersed within the cleaner composition to deposit the silicone oil droplets on a glass or a similar hard surface as a lubricated film.

It is another object of the embodiment described to provide a cleaner composition comprising distilled water to eliminate the possibility of contaminants inherent in the cleaning composition.

It is another object of the embodiment described to provide a cleaner composition comprising isopropyl alcohol for the purpose of dissolving greasy substances such as fingerprints on the surface being cleaned. It will be noted that the silicone oil is not dissolvable in the alcohol and water mixture.

It is a further object of the embodiment described to provide a cleaner composition comprising a surfactant to provide a means to loosen and hold in suspension dirt and grime from the surface being cleaned.

It is a further object of the embodiment described to provide a cleaner composition comprising essential oils to impart a pleasant fragrance to the composition.

It is yet another object of the embodiment described to provide a cleaner composition comprising colorants for visual enhancement of the composition.

The embodiment of the cleaner composition described herein is composed such that the silicone oil droplets remain suspended in the mixture until the cleaner composition is applied to the surface being cleaned. The oil droplets are then deposited to the surface as an adhered lubricated film which will aid in moving the applicator cloth over the surface without sticking and bunching up. This ease of motion is also evident after the solution has evaporated completely, allowing further wiping or buffing the surface, if necessary. Any remaining streaks are easily removed by the operator because the streaks are not strongly bonded to the surface but instead loosely adhered due to the applied silicone oil barrier film. This creates a perfectly clean, streak-free surface. The fact that the oil droplets remained suspended in the mixture, rather than dissolved in solution, presented a new and unexpected favorable result which became the basis of the embodiment described. The solvents in the embodiment described do not wash away the silicone film by the cleaning action.

DETAILED DESCRIPTION

The cleaner composition embodiment described herein is an aqueous liquid made up of an aqueous solution made up of distilled water and isopropyl alcohol, with the addition of a silicone oil, a surfactant, essentials oils and colorants.

The use of distilled water is preferable to eliminate any possibility of residual mineral deposits remaining on a surface being cleaned and thus increasing the likelihood of creating visible water spots and/or streaking.

The isopropyl alcohol as isopropanol is provided to dissolve oily substances such as fingerprints and the like. One embodiment of the cleaner composition includes 24% of isopropanol and 76% of distilled water to total volume of the cleaner composition. For example: To prepare approximately one liter of cleaner composition, 1000 milliliters, 240 ml of isopropanol is mixed with 760 ml of distilled water. See Table 1. The silicone oil in the form of polydimethylsiloxane is provided for creating an optically clear lubricated film on the surface being cleaned for ease of cleaning action. Adding silicone oil in the ratio of 0.066%, 0.66 ml to one liter, to the total volume of the cleaner composition creates a suspension of silicone oil droplets which are not dissolved into the other ingredients of the cleaner composition. When the cleaner composition is applied to a hard surface, the oil droplets are deposited on the surface, forming a slippery film. The film will remain on the surface during the cleaning action since the solvents in the composition will not dissolve the silicone oil. The silicone oil has a unique property in bonding specifically to a glass surface. As the surface is then wiped with an absorbent cotton or microfiber cloth, the lubricated surface aids in the wiping action by reducing friction and thus the tendency of the cloth to stick to and bunch up on the surface. In addition, the lubricated surface facilitates further polishing the surface, if necessary, after all liquid components have evaporated. Any remaining streaks are easily removed by the operator because the streaks are not strongly bonded to the surface but instead loosely adhered due to the applied silicone oil barrier film. This creates a perfectly clean, streak-free surface. The silicone oil also improves the clarity of a glass substrate by filling in and coating optical flaws and thus reducing reflections from sharp edges and scratches.

TABLE 1

| INGREDIENTS TO PRODUCE APPROXIMATELY 1 LITER (1000 ml) OF CLEANER COMPOSITION |
|---|
| 760 ml DISTILLED WATER |
| 240 ml ISOPROPYL ALCOHOL |
| 0.66 ml POLYDIMETHYLSILOXANE (Added to 1 liter of solution) |
| 1.32 grams SODIUM DODECYL SULFATE (Dissolves completely with no increase in volume) |
| ESSENTIAL OILS (As required. Added to 1 liter of solution) |
| 0.0026 ml to 0.132 ml COLORANTS (Added to 1 liter of solution) |

The surfactant, such as, for example, sodium dodecyl sulfate, in the amount of 1.32 grams per liter of solution is included to suspend dust, dirt, other solid materials, and water soluble contaminants which are then wiped off during the cleaning action.

Adding essential oils in a sufficient quantity will impart a pleasant fragrance to the cleaner composition.

The colorants FD&C blue and green in the amounts of 0.0026 to 0.132 milliliters per liter of solution add a distinctive hue to the composition.

The method of making or mixing the solution may be performed as follows: Initially, the isopropyl alcohol and distilled water are combined in a container. The silicone oil, surfactant, essential oils, and colorants are then added. The solution is agitated (shaken) to distribute the ingredients. As noted above, the silicone oil will not dissolve in the solution and will remain in suspension as small droplets. The finished product, cleaner solution, may then be sprayed on, or wiped on with a clean cotton or microfiber cloth. Using a paper towel is not recommended since some paper towel brands are impregnated with ingredients which may increase the likelihood of streaking.

It can be seen from the previous discussion of the embodiment of the cleaner composition described, that adding silicone oil to the composition provides significant advantages over known prior art. The oil forms droplets which remain in suspension in the solution and is not dissolved in the water and alcohol mixture in the composition. This allows the oil to be deposited on a hard surface, such as glass, rendering the surface somewhat hydrophobic, thus repelling the water and alcohol mixture containing the suspended contaminants. It will then become easy to wipe away these contaminants using a clean cotton or microfiber towel. In addition, the oil has a specific tendency to adhere to a glass surface, increasing the lubricity of the surface and therefore reducing the friction between the glass and the applicator towel significantly. The slippery film will remain on the glass surface since the water and alcohol mixture will not dissolve the silicone oil. This effect has the significant advantage of reducing the bonding of any potential streaks or dirt particles on the surface, thereby allowing the operator to easily polish the surface and achieve a perfect result, even after all the liquid ingredients in the product have evaporated. The alcohol and the surfactant components are included to dissolve and remove contaminants present.

While the above description contains several specific features, these should not be construed as limitations on the scope but rather an example of one embodiment thereof. Many other variations are possible. Other embodiments of the cleaner composition may alter the type of ingredients used as well as the proportions of the ingredients to enhance results. For example, purified water may be substituted for distilled water, another type of alcohol product may be used, or the brand of surfactant may be changed. Also, the essential oils and colorants may be altered to achieve a different result.

Thus, the scope of the disclosure should not be determined by the embodiment described but by the appended claims and their legal equivalents.

We claim:

1. A cleaner composition comprising:

silicone oil droplets in suspension within an aqueous solution for deposition of said silicone oil droplets within the cleaner composition on a hard surface such as glass, stainless steel and the like, the silicone droplets creating a lubricated film on said hard surface for ease of cleaning, and a surfactant comprising sodium dodecyl sulfate in a ratio of about 1.32 grams per liter of aqueous solution.

2. The cleaner composition of claim 1, wherein the aqueous solution comprises distilled water and isopropyl alcohol.

3. The cleaner composition of claim 1, wherein the silicone oil droplets comprise polydimethylsiloxane.

4. The cleaner composition of claim 3, wherein the suspension of droplets of silicone oil comprises about 0.66 ml of polydimethylsiloxane per liter of the aqueous solution.

5. A cleaner composition comprising:

silicone oil droplets in suspension within an aqueous solution for deposition of said silicone oil droplets within the cleaner composition on a hard surface such as glass, stainless steel and the like, the silicone droplets creating a lubricated film on said hard surface for ease of cleaning, and at least one essential oil selected from a group consisting of bergamot essential oil, patchouli essential oil, blood orange essential oil, yang yang essential oil and grapefruit essential oil.

6. The cleaner composition of claim 5, wherein the aqueous solution comprises distilled water and isopropyl alcohol.

7. The cleaner composition of claim 5, wherein the silicone oil droplets comprise polydimethylsiloxane.

8. The cleaner composition of claim 5, further comprising a surfactant.

9. The cleaner composition of claim 8, wherein the surfactant comprises sodium dodecyl sulfate.

10. The cleaner composition of claim 7, wherein the suspension of droplets of silicone oil comprises about 0.66 ml of polydimethylsiloxane per liter of the aqueous solution.

11. A cleaner composition comprising:

silicone oil droplets in suspension within an aqueous solution for deposition of said silicone oil droplets within the cleaner composition on a hard surface such as glass, stainless steel and the like, the silicone droplets creating a lubricated film on said hard surface for ease of cleaning, and at least one colorant selected from a group consisting of FD&C blue and FD&C green food coloring in amounts of 0.0026 to 0.132 milliliters per liter of aqueous solution.

12. The cleaner composition of claim 11, wherein the aqueous solution comprises distilled water and isopropyl alcohol.

13. The cleaner composition of claim 11, wherein the silicone oil droplets comprise polydimethylsiloxane.

14. The cleaner composition of claim 11, further comprising a surfactant.

15. The cleaner composition of claim 12, wherein the surfactant comprises sodium dodecyl sulfate.

16. The cleaner composition of claim 13, wherein the suspension of droplets of silicone oil comprises about 0.66 ml of polydimethylsiloxane per liter of the aqueous solution.

17. A cleaner composition comprising:

an aqueous solution of distilled water and isopropyl alcohol, a surfactant of sodium dodecyl sulfate in a ratio of about 1.32 grams per liter of the aqueous solution, droplets of silicone oil in suspension within the aqueous solution, at least one essential oil, and at least one colorant, the cleaner composition creating a lubricated film on a hard surface such as glass, stainless steel and the like.

18. The cleaner composition of claim 17, wherein the silicone oil droplets comprise polydimethylsiloxane.

19. The cleaner composition of claim 18, wherein the suspension of droplets of silicone oil comprises about 0.66 ml of polydimethylsiloxane per liter of the aqueous solution.

20. The cleaner composition of claim 17, wherein the at least one essential oil comprises one selected from a group consisting of bergamot essential oil, patchouli essential oil, blood orange essential oil, yang yang essential oil and grapefruit essential oil.

21. The cleaner composition of claim 17, wherein the at least one colorant is one selected from a group consisting of FD&C blue and FD&C green food coloring in an amount of 0.0026 to 0.132 milliliters per liter of the aqueous solution.

* * * * *